US005664666A

United States Patent [19]

Filla

[11] Patent Number: 5,664,666

[45] Date of Patent: Sep. 9, 1997

[54] ELECTRICAL SWITCH WHICH PREVENTS TACK WELDING

[75] Inventor: John J. Filla, St. Louis County, Mo.

[73] Assignee: Emerson Electric Co., St. Louis, Mo.

[21] Appl. No.: 149,294

[22] Filed: Nov. 9, 1993

[51] Int. Cl.[6] ..... H01H 1/26

[52] U.S. Cl. ..... 200/246; 200/559; 200/DIG. 42

[58] Field of Search ..... 200/DIG. 42, 440, 200/535, 559, 283, 284, 280, 250, 249, 240, 246

[56] References Cited

U.S. PATENT DOCUMENTS

| | | | |
|---|---|---|---|
| 2,896,041 | 7/1959 | Schwaneke | 200/246 |
| 3,953,697 | 4/1976 | Teichert | 200/243 |
| 4,061,895 | 12/1977 | Hults | 200/DIG. 42 |
| 4,105,882 | 8/1978 | Ulbing et al. | 200/DIG. 42 |
| 4,216,358 | 8/1980 | Brozille | 200/440 |
| 4,240,001 | 12/1980 | Hildebrandt et al. . | |
| 4,262,225 | 4/1981 | Hildebrandt et al. . | |
| 4,284,864 | 8/1981 | Crow et al. . | |
| 4,296,366 | 10/1981 | Hildebrandt et al. . | |
| 4,302,649 | 11/1981 | Ottersbach | 200/284 |
| 4,347,415 | 8/1982 | Falchi | 200/440 X |
| 4,473,789 | 9/1984 | Hildebrandt et al. . | |
| 4,504,710 | 3/1985 | Bryant et al. . | |
| 4,634,820 | 1/1987 | Noguchi | 200/440 X |
| 4,640,998 | 2/1987 | Sorenson | 200/440 |
| 4,645,886 | 2/1987 | Williams | 200/DIG. 42 |
| 4,658,196 | 4/1987 | Hildebrandt . | |
| 4,670,631 | 6/1987 | Peachee et al. . | |
| 4,697,860 | 10/1987 | Hildebrandt et al. . | |

FOREIGN PATENT DOCUMENTS

| | | | |
|---|---|---|---|
| 1140261 | 11/1959 | Germany | 200/DIG. 42 |
| 451138 | 11/1974 | U.S.S.R. | 200/440 |

*Primary Examiner*—Renee S. Luebke

*Attorney, Agent, or Firm*—Polster, Lieder, Woodruff & Lucchesi

[57] ABSTRACT

An electrical contact assembly of the present invention includes a body having a housing and a cover defining a space. A pair of spaced terminals are received in the space. One of the terminals has a contact formed at a free end thereof. The other contact has a spring arm secured to its free end. A contact is mounted on the spring arm in a position in which it can be moved into contact with the first contact. An extension is provided on the spring arm and a stop is provided in the body. When contact operation causes or attempts to cause tack welding of the two contacts, the stop extension operation maintains a spring force on the spring arm sufficiently strong to break the tack weld so that the contacts can be opened.

25 Claims, 3 Drawing Sheets

ELECTRICAL SWITCH WHICH PREVENTS TACK WELDING

BACKGROUND OF THE INVENTION

This invention relates to electrical contacts, for example as employed in starting switches used with fractional horsepower electric motors, and, in particular, to a switch which prevents tack welding of the switch contacts. While the invention is described in particular detail with respect to such switches, those skilled in the art will recognize the broader applicability of the invention disclosed hereinafter.

A prior art switch 100 is shown in FIG. 1. Switch 100 may be a switch such as is described in U.S. Pat. No. 4,302,649, which is incorporated herein by reference. The switch includes two terminals T1 and T2 each of which has a contact C1 and C2, respectively. The two contacts are brought together by an arm 101. Often, the switch operation over a period of time causes or attempts to cause the contacts to tack weld together. The terminal T2 has an arm 103 on which contact C2 is mounted. Arm 103 forms a leaf spring and generally has sufficient force to break the weld and separate the contacts. In particular, the switch assembly of FIG. 1 finds application with capacitor start motors. These kinds of motors have relatively low starting currents compared, for example, to a split phase motor. In adopting the switch of FIG. 1 to other motor types, certain problems developed. When motor starting current is increased, such as when the switch is used with a split phase motor, rather than a capacitor start motor, the weld becomes more tenacious. In these instances, the the spring force of the arm 103 is insufficient to break the weld and the contacts are not separated. In the case of a motor with starting windings, which require disconnection during normal run conditions, the starting windings will not be disconnected if the switch is not returned to its normal run position. This causes the starting windings to open, ruining the motor.

SUMMARY OF THE INVENTION

One object of the present invention is to provide a contact assembly which prevents tack welds between the contacts.

Another object is to provide such an assembly which is of rugged and economical construction and which is reliable in operation.

Another object is to provide such a switch which can easily be used with present motor constructions without redesigning the motor.

Another object of this invention is to provide an electrical contact assembly having an improved anti tack weld mechanism.

Another object of this invention is to provide an anti tack weld mechanism for a variety of electrical contact devices;

These and other objects will become apparent to those skilled in the art in light of the following disclosure and accompanying drawings.

In accordance with the invention, generally stated, an electrical assembly of the present invention, the form of the preferred embodiment being an electrical switch, includes a body having a housing and a cover for the housing defining a chamber. First and second terminals are received in the housing. The first terminal has a first contact at an end thereof. The second terminal has a spring arm at an end thereof. A second contact is secured to the spring arm in a position such that it will contact the first contact when the spring arm is moved towards the first contact. The spring arm is movable between a first position wherein the second contact is spaced from the first contact and a second position wherein the second contact meets the first contact.

A stop is formed in the body. An extension is formed on the spring arm which extends beyond the second contact towards the stop. The extension contacts the stop to maintain a spring force or leverage on the spring arm sufficiently strong to break any tack weld that tends to occur during switch operation so that the contacts may be separated and the circuit, of which the switch is a part, opens. The stop is preferably a wall which extends inwardly from a side wall of the housing. However, it may also be a post which extends from the cover or a bottom of the housing. The opening force exerted on the contacts may be varied in applicational use. The extension may be stiffened to increase the force on the spring arm. This may be done by making the extension thicker than the rest of the spring arm, such as by welding a thickening piece to the extension or folding the extension over upon itself.

BRIEF DESCRIPTION OF THE DRAWINGS

Corresponding reference characters indicate the corresponding parts through the several view of the drawings.

DESCRIPTION OF THE PREFERRED EMBODIMENT

Figure 2:
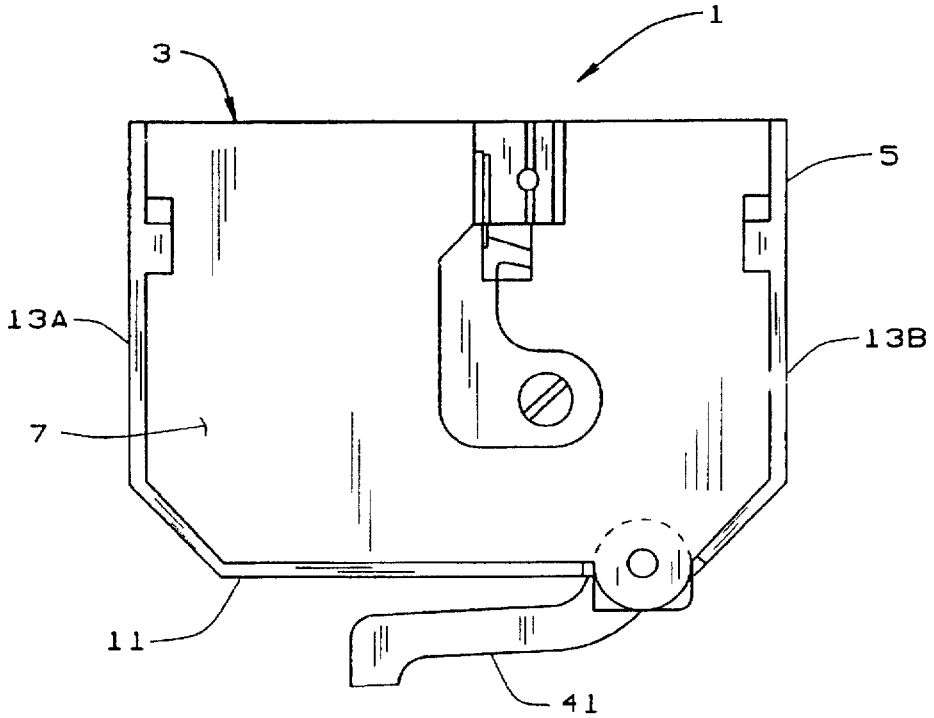
FIG. 2 is a front elevational view of one illustrative embodiment of electrical contact assembly of the present invention in the form of a switch.
Figure 3:
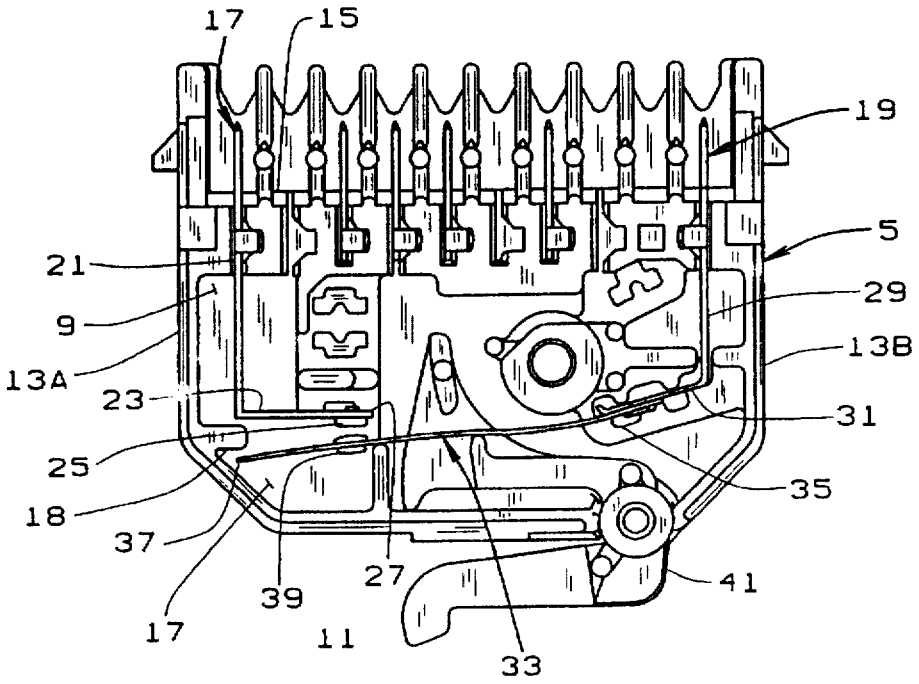
FIG. 3 is a front elevational view of the switch assembly with its cover removed showing the switch in its opened, or "run" position.

Referring now to FIG. 2, reference numeral 1 indicates one illustrative embodiment of a switch employing an electrical contact assembly of the present invention. Switch 1 includes a body 3 molded from a suitable electrically insulative material. Body 3 has a housing 5 and a cover 7 which define a chamber 9 (FIG. 3). Chamber 9 contains the operative parts of the switch. Chamber 9 is defined by a bottom wall 11, side walls 13A and 13B, a top wall 15, and a back wall 16 opposite cover 7 of body 3. A projection 18 extends inwardly from wall 13A. The switch, except as modified by electrical contact assembly of this invention, shown in the drawings generally is conventional and is described in U.S. Pat. Nos. 4,284,864, 4,296,366, 4,302,649, and 4,473,789. Certain aspects of the switch operation are described below. For brevity sake, the entire operation is not described. Those skilled in the art will recognize that additional structure may be employed in the operation of the switch shown in FIG. 4.

A pair of generally L-shaped terminals 17 and 19, made of an electrically conductive material (e.g. a brass alloy or the like), are received in chamber 9. Terminal 17 has a leg 21 which extends through top wall 15 near side wall 13A and a foot 23. Foot 23 extends generally perpendicularly from a bottom of leg 21 toward side wall 13B. A contact 25 is mounted to foot 23 at a free end 27 thereof. Terminal 17 is mounted in body 3 to be substantially positionally fixed.

Terminal 19 has a leg portion 29 which extends through top wall 15 near side wall 13B and a foot portion 31. Foot 31 extends from a bottom of leg 29 at an oblique angle toward wall 13A. Terminal 19, like terminal 17 is mounted in body 3 to be substantially positionally fixed.

A spring arm 33 has a fixed end 35 electrically connected to terminal 19 and a free end 37 which extends from foot 31 toward terminal 17. Foot 31 is angled with respect to leg 29 such that spring arm free end 37 is below housing projection 18. A second contact 39 is mounted on arm 33 between fixed end 35 and free end 37. Contact 39 is positioned such that it may contact contact 27 to complete an electrical circuit.

Figure 4:
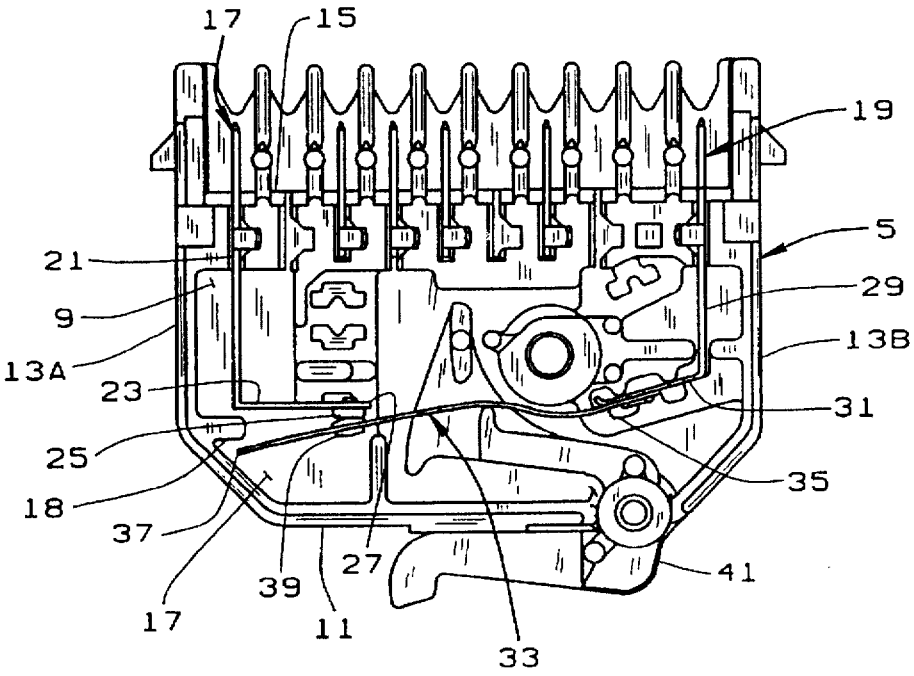
FIG. 4 is front elevational view similar to FIG. 3 showing the switch in its closed start or "on" position.

A swing arm 41 or other equivalent switch closing device extends through bottom wall 11. Swing arm 41 is operable to move switch arm 33 from an open or relaxed position, such as shown in FIG. 3, to a closed or start position, such as shown in FIG. 4. When swing arm 41 closes switch 1, spring arm 33 passes through a position, shown in FIG. 5, in which free end 37 contacts projection 18 to a position in which free end is spaced below projection 18, as shown in FIG. 4. When swing arm 41 is released, the normal spring force of arm 33 will return the switch to its open position (FIG. 3).

In high current applications, however, closing the contacts, for example, during normal switching operations, can cause the contacts to become tack welded together at their interface 40. (FIG. 5) If the weld is strong enough, the unaided spring force of the spring arm 33 will not be able to break the weld to separate the contacts. The switch, therefore, will move to the position shown in FIG. 5, wherein the contacts remain connected, the circuit remains closed, and the free end 37 of arm 33 is in contact with projection 18. Projection 18 is positioned in body 3 such that its contact with spring arm 33 exerts an additional spring force F in its arm 33. The spring force F is sufficiently strong that it breaks the weld between contacts 25 and 39 to separate the contacts and open the circuit. In other words, the position of projection 18 aids spring arm 33 in maintaining an opening force on weld 40 which will break the weld.

Figure 1:
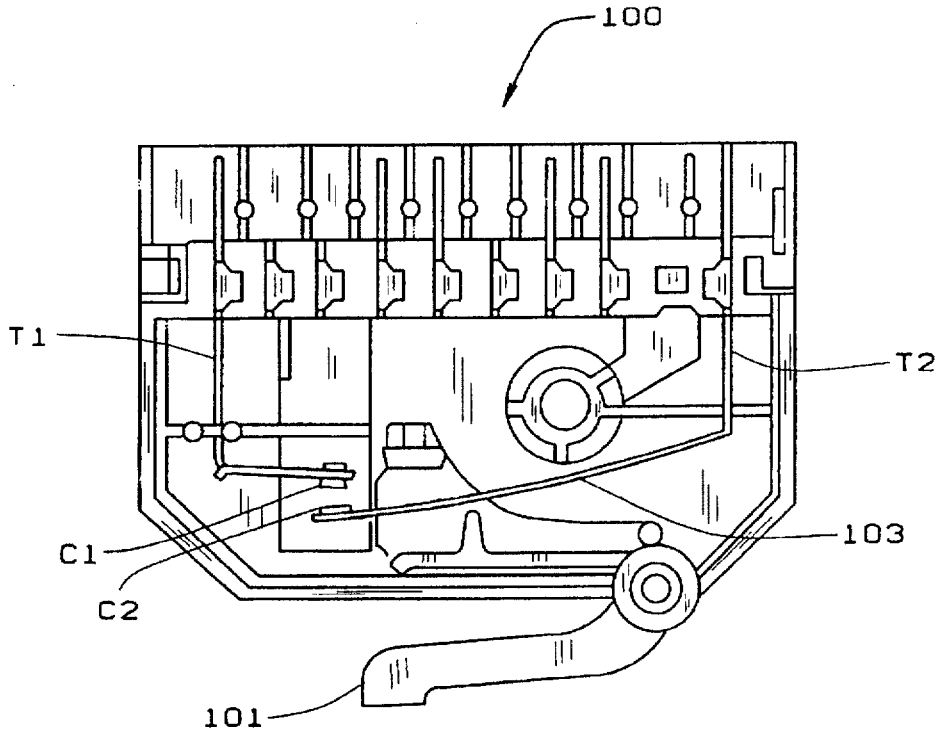
FIG. 1 PRIOR ART
FIG. 1 is a plan view of a prior art switch with its cover removed.
Figure 5:
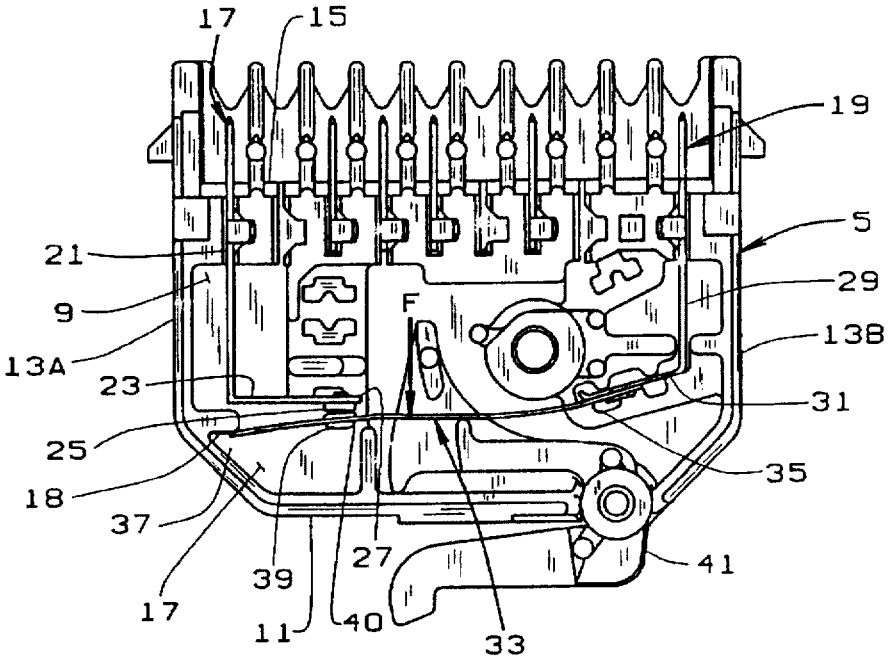
FIG. 5 is front elevational view similar to FIG. 3 showing the switch with welded contacts.
Figure 6:
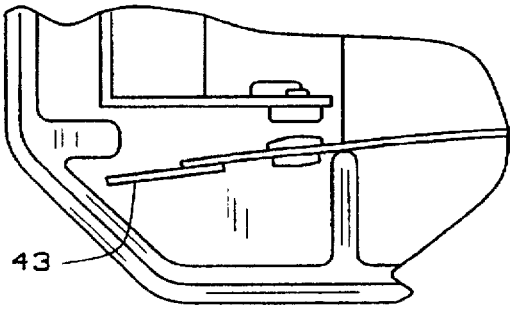
FIG. 6 is a fractional view of a second embodiment of the switch arm.
Figure 7:
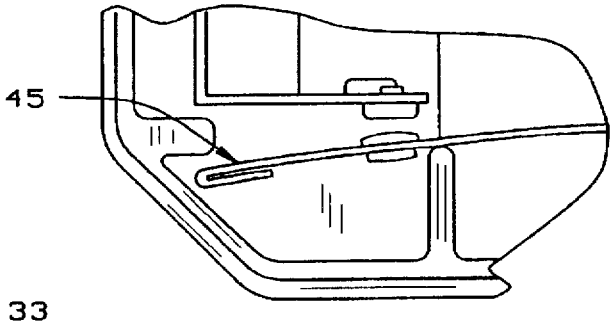
FIG. 7 is a fractional view of a third embodiment of the switch arm.

The spring arm may be a single continuous spring arm, such as shown in FIGS. 3–5. However, the spring arm may be such as is shown in FIG. 1 with an extension 43 added thereon. (FIG. 6) Extension 43 is sufficiently long to reach projection 18. To increase the stiffness, and hence the force F exerted on spring arm 33, the portion 45 may be thickened (FIG. 7), such as by bending the arm over itself or by welding a piece to the portion 45 to thicken it.

It is important to note that the electrical contact assembly of this invention does not add either additional parts or excessive cost to the assembly. In the switch of the preferred embodiment, the projection 18 is molded integrally with the switch housing, and the cost of increasing the length of arm 33 is minimal. The switch of the preferred embodiment finds application in dynamoelectric machines of the induction motor type, for example. The switches are operated by conventional centrifugal activators. The electrical contact assembly of this invention does not further increase the opposing force exhibited on the actuator by the switch except in order to close the contacts. That is to say, when there is an increase in force against the actuator prior to complete closure of the contacts, that increase is well within the actuation design parameters, and no redesign of the actuator is required.

Figure 8:
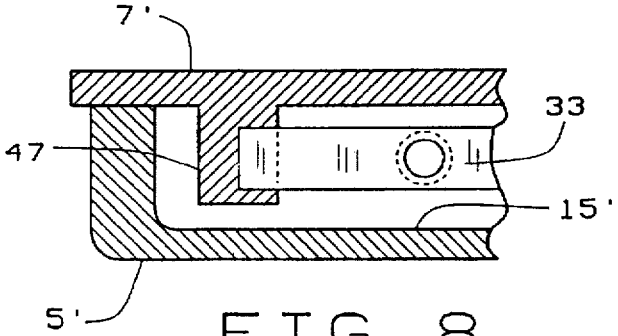
FIG. 8 is a fractional cross-sectional view of a second embodiment of the switch body.

Variations within the scope the appended claims may be apparent to those skilled in the art. For example, projection 18 may be replaced by a post 47 positioned to provide the leverage necessary to break a tack weld. Post 47 may extend from cover 7', as shown in FIG. 8, or may extend from back wall 15' of housing 5'. As will be appreciated by those skilled in the art, the electrical contact assembly of this invention can be applied to any contact assembly where contact weld is a problem. These examples are merely illustrative.

I claim:

1. An electrical switch assembly comprising:

a body defining a chamber;

a first terminal received in said chamber and having a first contact at an end thereof;

a second terminal having a spring arm at an end thereof, said spring arm extending towards said first terminal and having a second contact at a point remote from said second terminal, said spring arm being movable between a first position wherein said second contact is spaced from said first contact and a second position wherein said second contact is in contact with said first contact; and spring operated separating means for breaking a tack weld between said first and second contacts, said spring operated separating means primarily including an extension on said spring arm, the extension being integral with the spring arm.

2. An electrical switch assembly comprising:

a body including a housing and a cover for said housing, said housing and cover defining a chamber;

a first terminal received in said chamber and having a first contact at an end thereof;

a second terminal having a spring arm at an end thereof, said spring arm extending towards said first terminal and having a second contact at a point remote from said second terminal, said spring arm being movable between a first position wherein said second contact is spaced from said first contact and a second position wherein said second contact is in contact with said first contact; and separating means for breaking a tack weld between said first and second contacts; said separating means including an extension on said spring arm and a stop, said spring arm contacting said stop when said first and second contacts are tack welded, said stop being positioned to maintain a spring force in said spring arm sufficient to break said weld.

3. The switch assembly of claim 2 wherein said stop is formed integrally with said switch body.

4. The switch assembly of claim 2 wherein said stop comprises a projection which extends inwardly from a wall of said body, said first terminal being adjacent said wall.

5. The switch assembly of claim 2 wherein said stop comprises a post extending outwardly from a back of said housing.

6. The switch assembly of claim 2 wherein said stop comprises a post extending downwardly from said cover.

7. The switch assembly of claim 2 wherein said extension is integrally formed with said spring arm.

8. The switch assembly of claim 2 wherein said extension is thicker in cross-section than said spring arm.

9. The switch assembly of claim 8 wherein said extension is folded over upon itself to increase the thickness thereof.

10. In an electrical switch assembly comprising a body defining a chamber; a first terminal received in said chamber and having a first contact at an end thereof; a second terminal having a spring arm at an end thereof, said spring arm extending towards said first terminal and having a second contact at a point remote from said second terminal, said spring arm being movable between a first position wherein said second contact is spaced from said first contact and a second position wherein said second contact is in contact with said first contact; the improvement comprising a portion of said spring arm arranged to break a tack weld between said first and second contacts, said spring arm having sufficient spring force to break a tack weld between said first and second contacts when said spring arm is moved to said first position from said second position.

11. In an electrical switch assembly comprising a body defining a chamber; a first terminal received in said chamber and having a first contact at an end thereof; a second terminal having a spring arm at an end thereof, said spring arm extending towards said first terminal and having a second contact at a point remote from said second terminal, said spring arm being movable between a first position wherein said second contact is spaced from said first contact and a second position wherein said second contact is in contact with said first contact; the improvement comprising separating means for breaking a tack weld between said first and second contacts; said separating means including an extension on said spring arm and a stop in said body, said spring arm contacting said stop when said first and second contacts are tack welded, said stop being positioned to maintain a spring force in said spring arm sufficient to break said weld.

12. The improvement of claim 11 wherein said stop is formed integrally with said switch body.

13. The improvement of claim 11 wherein said stop comprises a projection which extends inwardly from a wall of said body, said first terminal being adjacent said wall.

14. The improvement of claim 11 wherein said stop comprises a post extending outwardly from a back of said housing.

15. The improvement of claim 11 wherein said stop comprises a post extending downwardly from said cover.

16. The improvement of claim 11 wherein said extension is integrally formed with said spring arm.

17. The improvement of claim 11 wherein said extension is thicker in cross-section than said spring arm.

18. The improvement of claim 17 wherein said extension is folded over upon itself to increase the thickness thereof.

19. An electrical contact assembly comprising:

a first terminal having a first electrical contact mounted thereto;

a second terminal having an arm electrically connected to it, said arm having a second electrical contact mounted to it, said arm being movable between a first position wherein said second contact is spaced from said first contact and a second position wherein said second contact normally electrically connects with said first contact; and means for breaking a tack weld between said first and second contacts, said tack breaking means including an extension of said arm and a stop, said extension dimensioned to contact said stop, said stop positioned with respect to said arm so as to exert an opening force on said contacts when opening of said contacts is desired, but to exert no force on the contacts in the normally electrically connected position of said contacts.

20. The contact assembly of claim 19 wherein said extension is integrally formed with said arm.

21. The electrical contact assembly of claim 20 wherein said extension is thicker in cross-section than said spring arm.

22. The electrical contact assembly of claim 21 wherein said extension is folded upon itself to increase the thickness thereof.

23. The electrical contact assembly of claim 19 wherein said extension is thicker in cross-section than said spring arm.

24. The electrical contact assembly of claim 19 wherein said extension is folded over upon itself to increase the thickness thereof.

25. The electrical contact assembly of claim 19 adopted for use as an electrical switch, said switch including a body having a housing, said housing defining a chamber, said stop being positioned within said switch body.

* * * * *